US012123219B1

(12) United States Patent
Zhao et al.

(10) Patent No.: US 12,123,219 B1
(45) Date of Patent: Oct. 22, 2024

(54) FRICTION ENERGY DISSIPATION COLUMN FOR BI-DIRECTIONAL DEFORMATION COOPERATIVE AND MULTI-STAGE WORKING

(71) Applicant: SOUTH CHINA UNIVERSITY OF TECHNOLOGY, Guangzhou (CN)

(72) Inventors: Junxian Zhao, Guangzhou (CN); Dinglian Ban, Guangzhou (CN); Wei Han, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 18/704,063

(22) PCT Filed: Mar. 24, 2023

(86) PCT No.: PCT/CN2023/083756
§ 371 (c)(1),
(2) Date: Apr. 24, 2024

(87) PCT Pub. No.: WO2024/040963
PCT Pub. Date: Feb. 29, 2024

(30) Foreign Application Priority Data

Aug. 26, 2022 (CN) ..... 202211038166.3

(51) Int. Cl.
*E04H 9/02* (2006.01)

(52) U.S. Cl.
CPC ..... *E04H 9/0237* (2020.05); *E04H 9/024* (2013.01)

(58) Field of Classification Search
CPC ..... E04H 9/0237; E04H 9/024
See application file for complete search history.

(56) References Cited

U.S. PATENT DOCUMENTS 7,076,926 B2 * 7/2006 Kasai ..... E04H 9/0237 52/167.7
10,989,638 B2 * 4/2021 Chen ..... G01N 3/08
(Continued)

FOREIGN PATENT DOCUMENTS

CN 211816916 10/2020
CN 113502980 10/2021
(Continued)

OTHER PUBLICATIONS

"International Search Report (Form PCT/ISA/210) of PCT/CN2023/083756," mailed on Sep. 20, 2023, with English translation thereof, pp. 1-4.
(Continued)

*Primary Examiner* — Rodney Mintz
(74) *Attorney, Agent, or Firm* — JCIPRNET

(57) ABSTRACT

A friction energy dissipation column for bi-directional deformation cooperative and multi-stage working, includes two cantilever part I-shaped steel columns, a middle part I-shaped steel column, wherein the middle part I-shaped steel column is located between the two cantilever part I-shaped steel columns, and the middle part I-shaped steel column is detachably connected to the two cantilever part I-shaped steel columns via a pin shaft connector and a friction energy dissipation assembly. An upper end and a lower end web of the friction energy dissipation column are connected to the frame beam via a connecting plate, and the flanges on both sides are provided with haunched supports.

13 Claims, 10 Drawing Sheets

(56) References Cited

U.S. PATENT DOCUMENTS

| | | | | |
|---|---|---|---|---|
| 11,808,026 | B2 * | 11/2023 | Zhao | E04B 1/2403 |
| 2004/0074161 | A1 | 4/2004 | Kasai et al. | |
| 2021/0048380 | A1 * | 2/2021 | Chen | G01N 3/08 |
| 2022/0154445 | A1 * | 5/2022 | Zhao | E04H 9/024 |

FOREIGN PATENT DOCUMENTS

| | | |
|---|---|---|
| CN | 215166514 | 12/2021 |
| CN | 115492234 | 12/2022 |
| JP | 2008095467 | 4/2008 |
| KR | 101705318 | 2/2017 |

OTHER PUBLICATIONS

"Written Opinion of the International Searching Authority (Form PCT/ISA/237) of PCT/CN2023/083756," mailed on Sep. 20, 2023, pp. 1-4.

* cited by examiner

A –A

B–B

FRICTION ENERGY DISSIPATION COLUMN FOR BI-DIRECTIONAL DEFORMATION COOPERATIVE AND MULTI-STAGE WORKING

CROSS-REFERENCE TO RELATED APPLICATION

This application is a 371 of international application of PCT application serial no. PCT/CN2023/083756, filed on Mar. 24, 2023, which claims the priority benefit of China application no. 202211038166.3, filed on Aug. 26, 2022. The entirety of each of the above mentioned patent applications is hereby incorporated by reference herein and made a part of this specification.

TECHNICAL FIELD

The present invention relates to the field of seismic resistance of building structures, and in particular to a friction energy dissipation column for bi-directional deformation cooperative and multi-stage working.

BACKGROUND ART

The technology of seismic energy dissipation refers to the installation of dampers in certain parts of the structure, and the reasonable design makes the dampers yield before the main structure, so as to dissipate the energy of the earthquake input into the structure and achieve an effective seismic resistant means to protect the main structure. Common types of dampers are: metal dampers, friction dampers, viscous dampers, viscoelastic dampers, etc. These dampers are commonly arranged in a structure in a diagonal bracing-type arrangement, a herringbone-type arrangement, a toggle-type arrangement, and a pier-type connection, as shown in (A) of FIG. 1 to (D) of FIG. 1. In these common arrangements, the pier-type connection has the following advantages: (1) Little effect on the function of building: it has a certain space on both sides of the substructure with dampers, which can meet the needs of door and window layout; (2) Low cost and conducive to the application, compared to diagonal bracing-type arrangement, a herringbone-type arrangement, a toggle-type arrangement; (3) Wide applicability: it can be used for installation including metal damper, friction damper and viscoelastic damper.

Pier-type connection can save building space, and the advantages of a wide application range are important for building function, which will be an important direction of practical engineering application in the future. However, for the pier-type dampers, often, only the in-plane force is considered in the design, while the actual seismic action is bi-directional, and the damper itself will not only deform in the plane, but also out of the plane. As shown in FIG. 2, when the damper has sufficient out-of-plane stiffness, it mainly occurs the rigid body rotation of the damper, and the out-of-plane deformation mainly occurs on the pier and the frame beam; when the damper has insufficient out-of-plane stiffness, the pier, the damper and the frame beam all undergo out-of-plane bending deformation. Whether the out-of-plane stiffness of the damper is sufficient or not, the pier will be deformed out-of-plane. When the out-of-plane deformation is too large, the pier will be damaged out-of-plane, and will exit the work in advance, so that the energy dissipation effect of the damper fails, which is not conducive to the effective performance of energy dissipation and damping.

Metal dampers are often used as energy dissipation components of pier-type dampers because of their high energy dissipation capacity, good durability, relatively low cost, and convenient installation and replacement. It should be noted that when inter-story drift is large, the metal damper will also have a large bending or shear deformation, which will lead to obvious deformation concentration of the metal damper, and thus the local stress is too large, which is not conducive to the effective performance of its low-cycle fatigue performance.

Chao ZHANG etc. proposed an adjustable energy dissipation prefabricated wall column (application number CN202110822197.7), comprising a prefabricated lower pier component, a prefabricated upper pier component, a damper component, and a vertical adjustment component. However, the out-of-plane deformation is not considered in this kind of pier type. The upper and lower piers are prone to out-of-plane bending failure, and the metal dampers between the upper and lower piers are prone to deformation concentration under large reciprocating displacement.

SUMMARY OF THE INVENTION

To solve the problems that pier-type dampers are prone to out-of-plane failure when the upper and lower piers are stressed in two directions under actual earthquakes, and there is strain concentration when using metal energy dissipation technology, the present invention proposes a friction energy dissipation column for bi-directional deformation cooperative and multi-stage working, which can not only save the space used in buildings but also effectively exert the effect of seismic energy dissipation.

In order to achieve the object of the present invention, the present invention provides a friction energy dissipation column for bi-directional deformation cooperative and multi-stage working, comprising cantilever part I-shaped steel columns, a middle part I-shaped steel column, a friction energy dissipation assembly, and a pin shaft connector;

The middle part I-shaped steel column is located between the two cantilever part I-shaped steel columns, and the two cantilever part I-shaped steel columns are aligned with an central axis of the middle part I-shaped steel column;

Each of the cantilever part I-shaped steel columns is detachably connected to the middle part I-shaped steel column via a friction energy dissipation assembly and a pin shaft connector;

the friction energy dissipation assemblies are respectively symmetrically arranged on both sides of webs of the cantilever part I-shaped steel column and of webs of the middle part I-shaped steel column.

Further, a web of an upper cantilever part I-shaped steel column is connected to the frame beam via an upper connecting plate, the upper cantilever part I-shaped steel column and the upper connecting plate are both provided with circular holes in one-to-one correspondence, the upper cantilever part I-shaped steel column is fixedly connected to the upper connecting plate via a bolt, and the web of the upper cantilever part I-shaped steel column and the frame beam web are located in a same plane:

a web of a lower cantilever part I-shaped steel column is connected to the frame bottom beam via a lower connecting plate, the lower cantilever part I-shaped steel column is provided with circular holes, the lower connecting plate is provided with a vertical slotted hole, the lower cantilever part I-shaped steel column is fixedly connected to the lower connecting plate via a bolt, and the web of the lower cantilever part I-shaped steel column and the web of the frame bottom beam are located in a same plane.

Further, the left and right side flanges of the two cantilever part I-shaped steel columns are provided with a haunched support respectively.

Further, the haunched support comprises a triangular haunched plate, a first end plate, and a second end plate, wherein the first end plate is fixedly connected to the frame beam flange, and the second end plate is fixedly connected to the side flange of the cantilever part I-shaped steel column; the triangular haunched plate and the web of the cantilever part I-shaped steel column are located in a same plane; in addition, the first end plate and the second end plate are provided with a gap at a right angle of the triangular haunched plate so as not to contact each other.

Further, a plurality of circular bolt holes are provided at the right side flange and the web of the cantilever part I-shaped steel column, and the bolt holes at the right side flange are symmetrically arranged at both sides of the web; the right side flange and the web of the middle part I-shaped steel column are respectively provided with slotted holes, and the slotted holes at the right side flange are symmetrically arranged at both sides of the web, and the circular bolt hole and the slotted hole are used for installing the friction energy dissipation assemblies.

Further, the friction energy dissipation assembly comprises a friction steel plate, a friction angle steel, and a triangular stiffener, wherein the friction steel plate is detachably connected to the right side of the right side flange of the cantilever part I-shaped steel column and of the right side flange of the middle part I-shaped steel column, the friction angle steel is detachably connected to the right side flange of the I-shaped steel column and the right side flange of the middle part I-shaped steel column, the friction angle steel is also detachably connected to the web of the I-shaped steel column and the web of the middle part I-shaped steel column, and the two friction angle steel are symmetrically arranged on both sides of the webs of the cantilever part I-shaped steel column and of the webs of the middle part I-shaped steel column.

Further, a first friction plate is provided between the friction steel plate and the right side flange of the cantilever part I-shaped steel column and between the friction steel plate and the right side flange of the middle part I-shaped steel column, and a second friction plate is provided between the friction angle steel and the right side flange of the cantilever part I-shaped steel column and between the friction angle steel and the right side flange of the middle part I-shaped steel column; a low friction material is provided between the friction angle steel and the web of the cantilever part I-shaped steel column and between the friction angle steel and the web of middle part I-shaped steel column;

An upper friction energy dissipation assembly and a lower friction energy dissipation assembly of the friction energy dissipation column apply a bolt pretention force, the bolt pre-tention force applied by the lower friction energy dissipation assembly is lower than the bolt pre-tention force applied by the upper friction energy dissipation assembly.

Further, the friction angle steel is provided with four triangular stiffeners, wherein one side of two of the triangular stiffeners is respectively flush with an end face of the cantilever part I-shaped steel column and an end face of the middle part I-shaped steel column, and another two of the triangular stiffeners are symmetrically arranged at both sides of the friction angle steel.

Further, the pin shaft connector comprises two main ear plates, two auxiliary ear plates, and a pin shaft, wherein the main ear plates are symmetrically welded on the left side flange of the cantilever part I-shaped steel column, and the auxiliary ear plates are symmetrically welded on the left side flange of the middle part I-shaped steel column, the main ear plates are connected to the auxiliary ear plates via the pin shaft, the two main ear plates are respectively located outside the two auxiliary ear plates, and a gap is provided between each main ear plate and each auxiliary ear plate.

The present invention also provides a method for processing the above-mentioned friction energy dissipation column for bi-directional deformation cooperative and multi-stage working.

comprising the following steps of:

Step 1. connecting one end of the cantilever part I-shaped steel column located above to one end of the middle part I-shaped steel column using a pin shaft connector;

Step 2. connecting another end of the upper cantilever part I-shaped steel column to another end of the middle part I-shaped steel column via a friction energy dissipation assembly:

Step 3. connecting the cantilever part I-shaped steel column located below with the middle part I-shaped steel column according to a same process;

Step 4. transporting the connected friction energy dissipation column to a construction site, fixing an upper connecting plate at the end of the cantilever part I-shaped steel column located above, and fixing a lower connecting plate at the end of the cantilever part I-shaped steel column located below;

When the haunched supports are provided, the haunched supports are respectively fixedly installed at left and right side flanges of the two cantilever part I-shaped steel columns.

Further, before step 1, circular holes are provided on the upper connecting plate, the cantilever part I-shaped steel column, the friction angle steel and the friction steel plate at corresponding positions, slotted holes are provided on the lower connecting plate, slotted holes are provided on the middle part I-shaped steel column, and two main ear plates are welded on the flange of the cantilever part I-shaped steel column, two auxiliary ear plates are welded on the flange of the middle part I-shaped steel column, the upper connecting plate provided with a circular hole is welded on the lower flange of the frame beam, and the lower connecting plate provided with a slotted hole is welded on the upper flange of the frame bottom beam.

Compared with the prior art, the invention has the following beneficial effects:

(1) It can effectively reduce the deformation concentration problem caused by metal damping technology. As shown in FIG. 3, the pin shaft connection between the cantilever part column and the middle part column is equivalent to an ideal hinge point; when an inter-story drift occurs between the upper and lower floors, the relative horizontal displacement between the floors is converted into a rigid body corner deformation between the two cantilever part columns and the middle part column; one of the two fractures opens and deforms around the hinge point, and the other fracture closes and deforms around the hinge point; and both the opening deformation and the closing deformation enable the middle part column to slide relative to the friction plate, thereby friction dissipating seismic energy. It can be seen from the geometric relationship in the figure that the relative sliding linear displacement $\delta=\theta h=\Delta h/(H\xi)$ ($\theta$ is the relative rotation angle between column parts, h is the cross-sectional height of the I-shaped steel column, θh is the relative sliding linear displacement, Δ is the translational displacement between floors, H is the total length of the energy dissipation column, Hξ is the length of the middle part column) caused by the rotation angle deformation is far less than the horizontal displacement between floors A, so that the problem of strain concentration can be effectively alleviated and the low-cycle fatigue performance of the damper can be improved.

(2) It can effectively avoid out-of-plane damage to the upper and lower columns and ensure the normal performance of the damper in the plane. The upper and lower cantilever part columns are connected to the frame beam via a connecting plate and a haunched support, the connecting plate, web of the cantilever part column and the haunched support present rigidity in the plane of the frame, and have a good bending deformation capacity and present flexibility out of the plane; when the energy dissipation column is subjected to a bi-directional seismic load, the upper and lower connecting joints of the energy dissipation column present rigid connection in the plane, ensuring that the in-plane working mechanism can function normally (as shown in FIG. 3); While the out-of-plane connection of the upper and lower connecting joints is a flexible connection, that is to say, the out-of-plane deformation of the energy dissipation column is borne by the upper and lower connecting plates, the partial webs of the cantilever part columns and the triangular haunched plates of the haunched support, and the out-of-plane deformation of the upper and lower cantilever part columns as a whole is small; at the same time, the friction angle steel, the triangular stiffeners and the pin shaft connection of the double ear plates between the column parts enable the fracture to have a strong resistance to the out-of-plane deformation, and there is no out-of-plane torsional deformation between the three column parts; therefore, the out-of-plane working mechanism of the energy dissipation column can be simplified as the out-of-plane flexibility of the connecting joints as shown in FIG. 4. The working mechanism of the whole energy dissipation column has no bending deformation in the out-of-plane direction. The structure of the out-of-plane flexible connection and in-plane rigid connection of the connecting joint will avoid the possibility of out-of-plane damage to the upper and lower piers of the traditional pier-type damper, and ensure the performance of the damper in-plane.

(3) It has little effect on the function and space of the building. With respect to common arrangement methods of dampers, such as diagonal bracing-type arrangement, herringbone-type arrangement, and toggle-type arrangement, the energy dissipation column proposed in the present invention occupies a small building space, and the remaining building space can be very convenient for opening doors and windows, thus greatly reducing the influence of the support system on the building functionality. Moreover, in order to ensure that the piers of pier-type dampers are not damaged under the action of limit damping force, it is often necessary to increase the cross-sectional height of piers, so that they still occupy a large building space. Moreover, the cross-sectional height of the energy-dissipating column proposed by the present invention is similar to that of a frame beam, and it occupies a smaller building space than a pier-type damper. It can also be dispersed in the structure, thereby dispersing the force demand of a single damper and reducing the adverse impact on the substructure.

(4) Multi-stage energy dissipation can be achieved. Materials with strong wear resistance and stable friction performance such as brass and the like may be selected to be the material of the friction plate of the friction energy dissipation column, and the bolt pre-tention force exerted by the friction energy dissipation assembly at the lower side is lower than that exerted by the friction energy dissipation assembly at the upper side. By further rational design, it can be realized that only the friction damper at the lower side participates in energy dissipation under minor earthquakes, and both the friction energy dissipation assemblies at the upper and lower side participate in energy dissipation under moderate to strong earthquakes, so as to achieve the purpose of multi-stage energy dissipation.

DETAILED DESCRIPTION OF THE INVENTION

Figure 1:
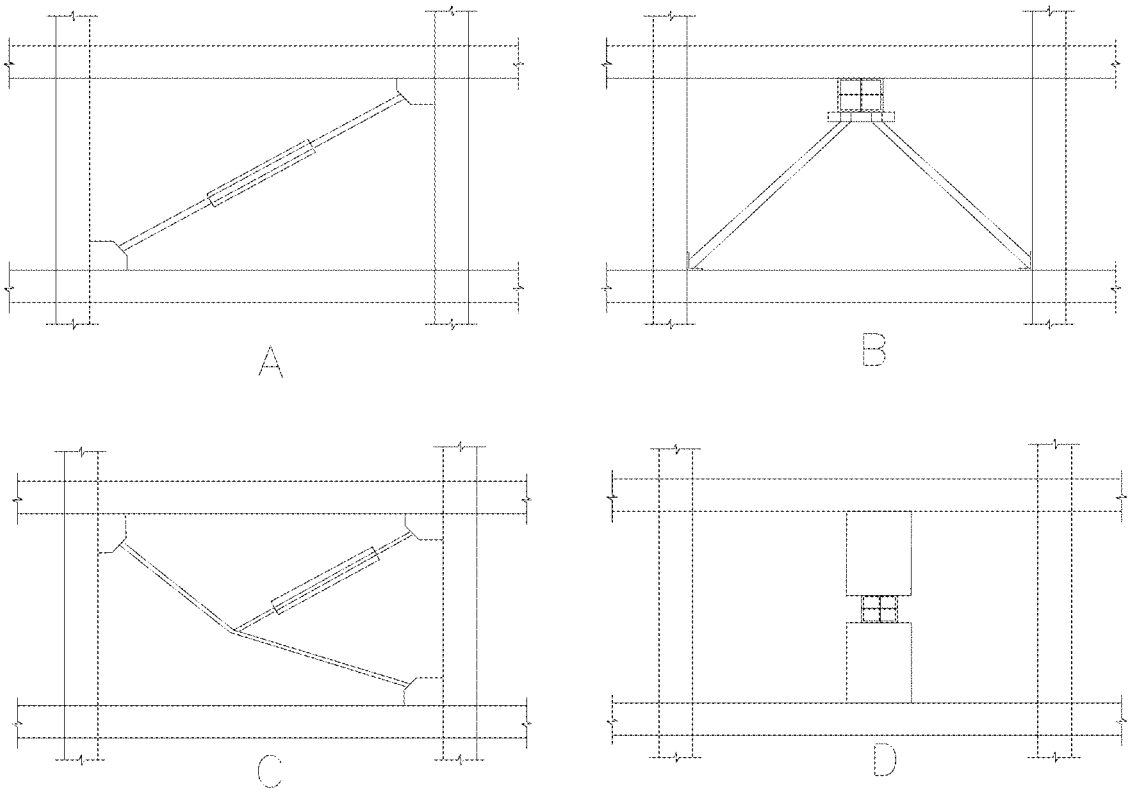
FIG. 1 is a diagram of a common connection type for providing dampers in a beam-column bay.
Figure 2:
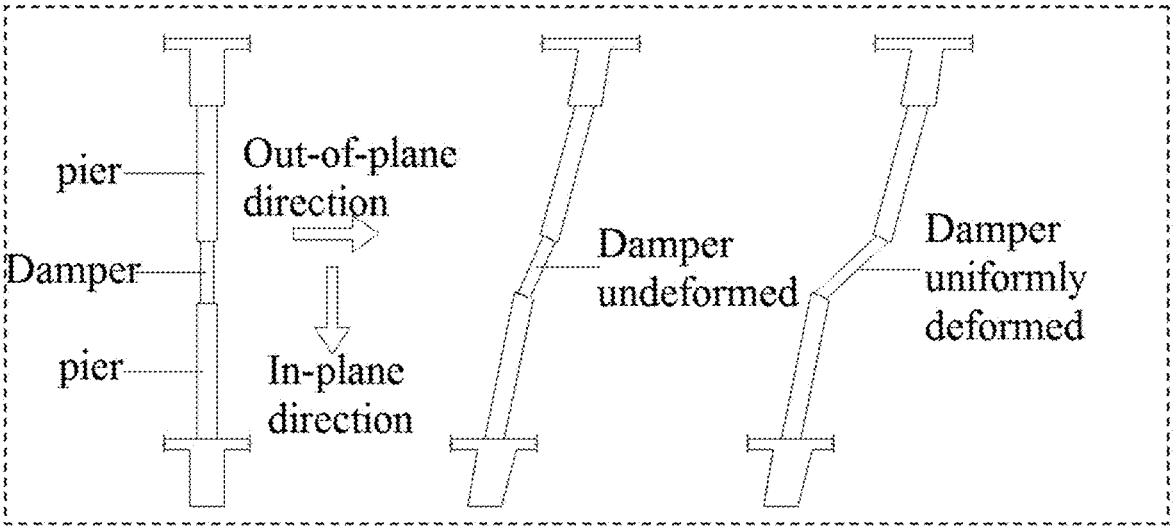
FIG. 2 is a schematic view illustrating the out-of-plane deformation of an existing pier-type damper.
Figure 3:
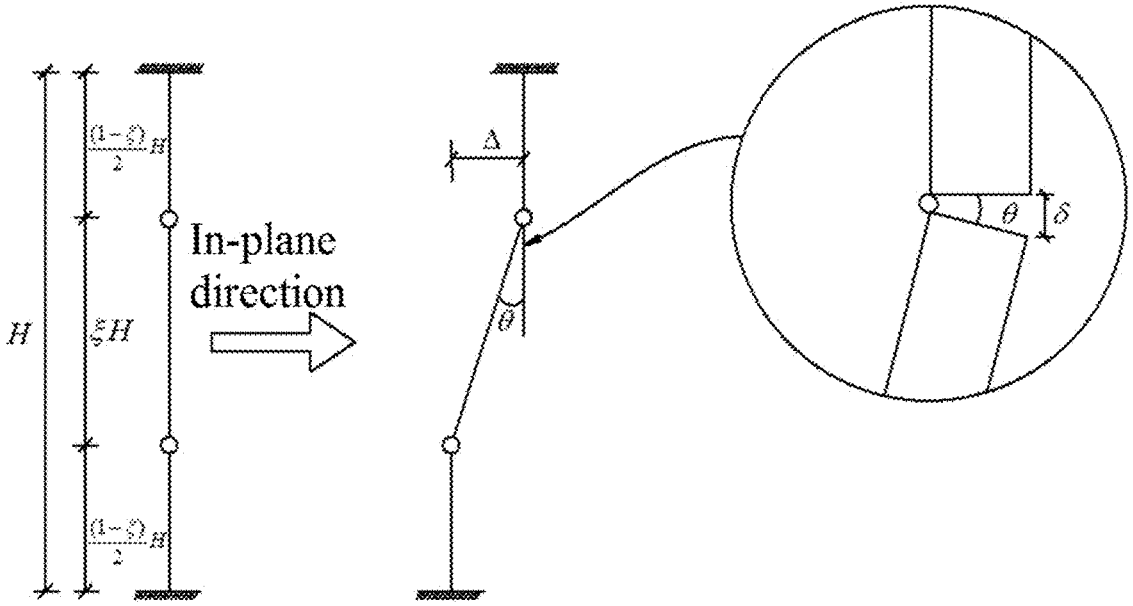
FIG. 3 is a schematic view of the in-plane structure-joint deformation relationship of a friction energy dissipation column.
Figure 4:
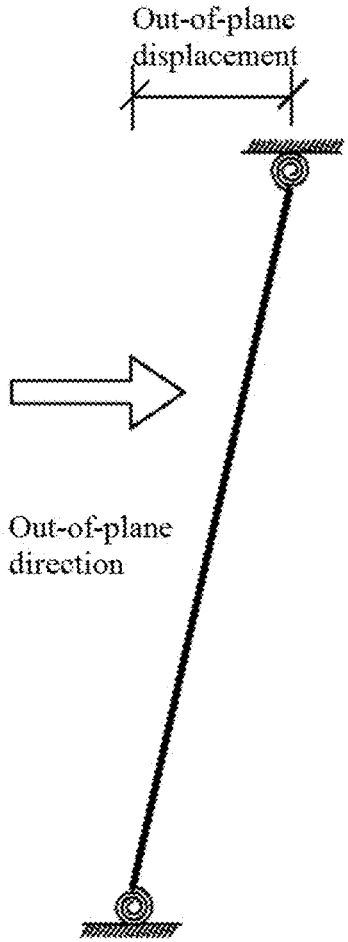
FIG. 4 is a simplified view of the out-of-plane deformation of a friction energy dissipation column.

In order that the objects, aspects, and advantages of the present invention will become more apparent, a more particular description of the invention will be rendered by reference to the appended drawings and examples. It should be understood that the particular embodiments described herein are illustrative only and are not limiting.

In the description of the present invention, it should be noted that the terms "central", "upper", "lower", "left", "right", "vertical", "horizontal", "inner", "outer", and the like indicate orientations or positional relationships based on the orientation or positional relationships shown in the drawings, are merely for convenience in describing and simplifying the present invention, and do not indicate or imply that the referenced devices or elements must have a particular orientation, be constructed and operated in a particular orientation, and thus are not to be construed as limiting the invention; Furthermore, unless expressly stated or limited otherwise, the terms "mounted", "connected", and "connected" are to be interpreted broadly, e.g. as a fixed connection, as a detachable connection, or as an integral connection; It can be directly connected or indirectly connected through an intermediate medium and can be the internal communication of two components. The specific meaning of the above terms in the present invention can be understood by those skilled in the art according to specific circumstances.

With reference to FIG. 5A to FIG. 9, a two-way deformation cooperative and multi-stage working friction energy dissipation column comprises two cantilever part I-shaped steel columns 1, one middle part I-shaped steel column 2, two friction energy dissipation assemblies 7 and two pin shaft connectors 6; the middle part I-shaped steel column 2 is located between the two cantilever part I-shaped steel columns 1, and the two cantilever part I-shaped steel columns 1 are aligned with the central axis of the middle part I-shaped steel column 2 so as to facilitate the connection between the column parts; the left side of the cantilever part I-shaped steel column 1 is connected to the left side of the middle part I-shaped steel column 2 via a pin shaft connector 6 comprising two pairs of ear plates, and the right side of the cantilever part I-shaped steel column 1 is connected to the right side of the middle part I-shaped steel column 2 via a friction energy dissipation assembly 7; the friction energy dissipation assemblies 7 are symmetrically arranged on both sides of the webs of the cantilever part I-shaped steel column 1 and of the webs of the middle part I-shaped steel column 2.

In some embodiments of the present invention, as described in conjunction with FIG. 5B, FIG. 9-FIG. 11 and FIG. 13, the web of the cantilever part I-shaped steel column 1 located above are connected to the frame beam 8 at the top via the upper connecting plate 3, the upper connecting plate 3 is provided with a mounting hole, and the web of the upper cantilever part I-shaped steel column 1 is provided with circular holes in one-to-one correspondence to the mounting hole of the upper connecting plate 3 so as to ensure that the two can be fixedly connected to each other via a bolt; the web of the lower cantilever part I-shaped steel column 1 is connected to the frame bottom beam via a lower connecting plate 4, and the web of the lower cantilever part I-shaped steel column 1 is provided with circular holes, and the lower connecting plate 4 is provided with a vertical slotted hole, so as to adjust the spacing when the friction energy dissipation column is installed, and ensure that it can be installed.

In some of the embodiments of the present invention, as described with reference to FIG. 5A, FIG. 5B, FIG. 12, FIG. 15, and FIG. 16, the connection between the upper and lower cantilever part I-shaped steel columns 1 and the frame beam is provided with a haunched support 5 at the left and right side flanges of the cantilever part I-shaped steel columns 1 in addition to the connecting plate. Each of the haunched supports 5 comprises a triangular haunched plate 53, a first end plate 51, and a second end plate 52, wherein in actual installation, the first end plate 51 is fixedly connected to the flange of the frame beam 8 via a bolt, and the second end plate 52 is fixedly connected to the side flange of the cantilever part I-shaped steel column 1 via a bolt; the triangular haunched plate 53 is located on the same plane as the web of the cantilever part I-shaped steel column 1 and the web of the frame beam; The first end plate 51 and the second end plate 52 are provided with a certain gap at a right angle of the triangular haunched plate 53 so as not to contact each other. With such arrangement, the bending resistance in the out-of-plane direction of the energy dissipation column is mainly provided by the webs, the upper and lower connecting plates 3, 4, and the triangular haunched plates 53 at the connecting joint of the cantilever part I-shaped steel column 1 under the bi-directional seismic action, and the moment of inertia in the out-of-plane direction of the three is relatively small compared with that in the in-plane direction. Therefore, the connecting joint in the out-of-plane direction presents flexibility to bear the bending deformation in the out-of-plane direction of the energy dissipation column, and the in-plane direction presents rigidity to ensure the working performance in the energy dissipation column.

In some embodiments of the present invention, as described in conjunction with FIG. 5A, FIG. 5B, FIG. 8, and FIG. 9, a plurality of circular bolt holes are provided at the right flange and the web of the cantilever part I-shaped steel column 1, and the bolt holes at the flange are symmetrically arranged at both sides of the web; the right side flange and the web of the middle part I-shaped steel column 2 are provided with slotted holes, and the slotted holes at the flange are symmetrically arranged at two sides of the web; the cantilever part I-shaped steel column 1 is provided with circular holes while the middle part I-shaped steel column 2 is provided with slotted holes, so that only the middle part I-shaped steel column 2 slides relative to the friction plate when the column parts rotate relative to each other, thereby dissipating seismic energy.

In some of the embodiments of the present invention, described in connection with FIG. 5A, FIG. 5B, FIG. 6, FIG. 7, FIG. 8, FIG. 9, the friction energy dissipation assembly 7 comprises one friction steel plate 73, two friction angle steel 75, and eight triangular stiffeners 76 respectively arranged on the two friction angle steel 75; the friction steel plate 73 is detachably connected to the right sides of the right side flange of the cantilever part I-shaped steel column 1 and of the right side flange of the middle part I-shaped steel column 2, two friction angle steel 75 are symmetrically arranged at both sides of the web of the cantilever part I-shaped steel column 1 and of the web of the middle part I-shaped steel column 2, and are fixedly connected to the cantilever part I-shaped steel column 1 and the middle part I-shaped steel column 2 via bolts; the friction steel plate 73 and the friction angle steel 75 are provided with a plurality of circular bolt holes to connect the cantilever part I-shaped steel column 1 with the middle part I-shaped steel column 2 via bolts.

Figure 5A:
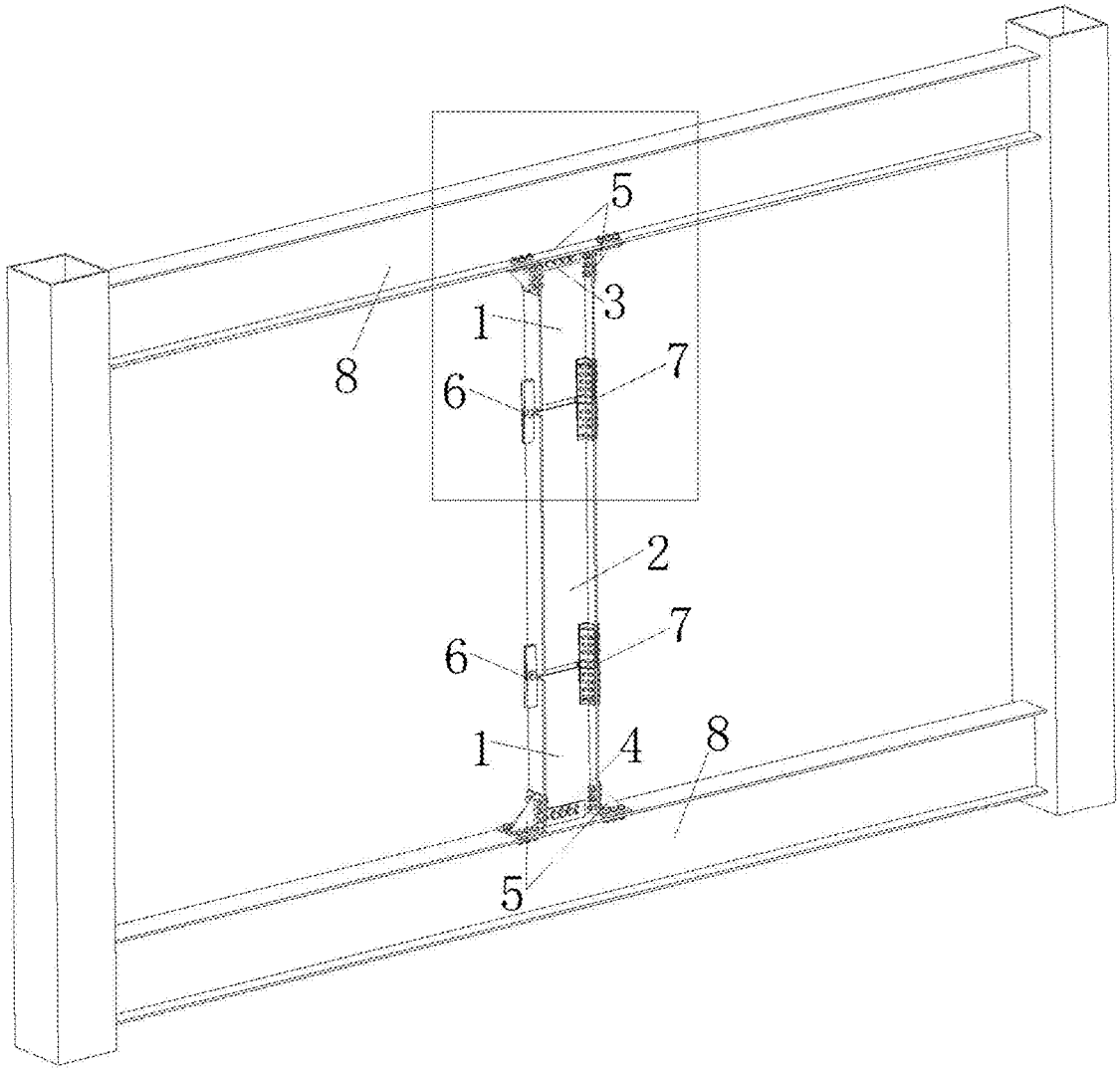
FIG. 5A is a schematic view of a friction energy dissipation column according to an embodiment of the present invention.
Figure 5B:
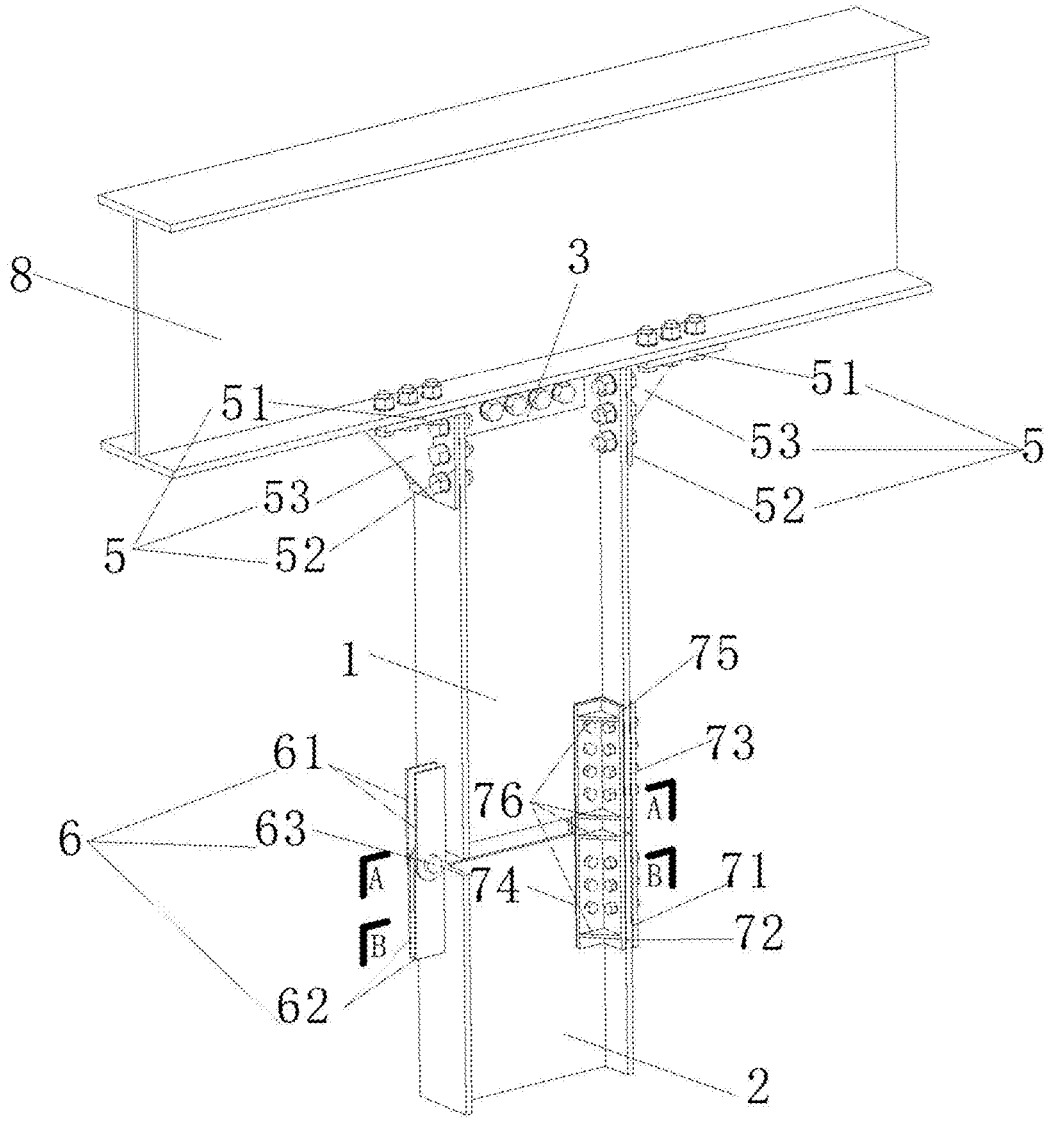
FIG. 5B is an enlarged partial view of FIG. 5A.
Figure 6:
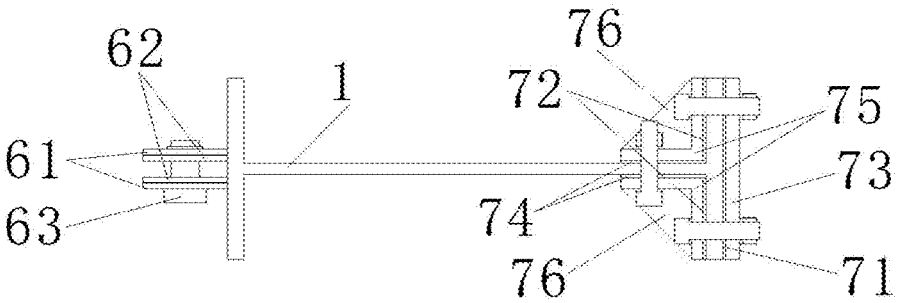
FIG. 6 is a cross-sectional view of FIG. 5B along A-A.
Figure 7:
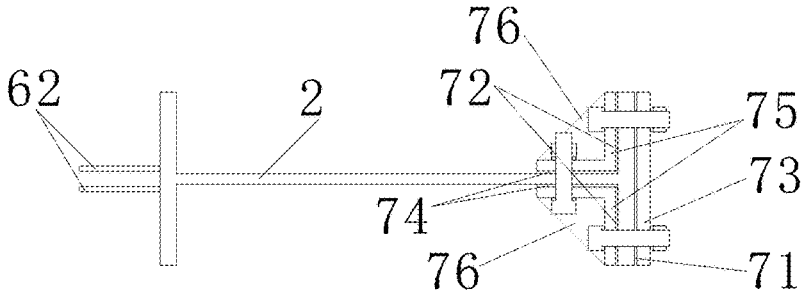
FIG. 7 is a cross-sectional view of FIG. 5B along B-B.
Figure 8:
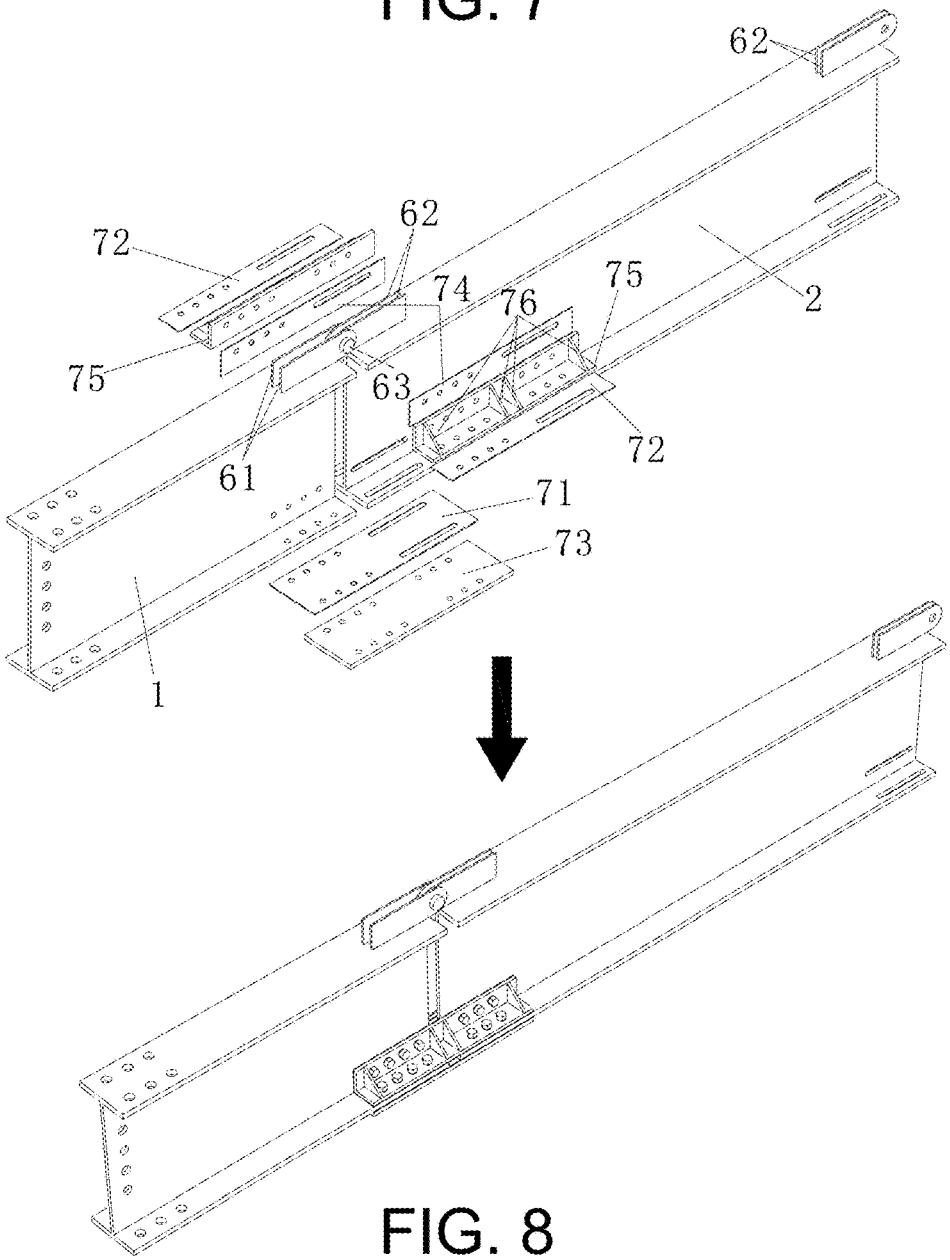
FIG. 8 is a schematic view of the process of connecting the upper cantilever part I-shaped steel column to the middle part I-shaped steel column.
Figure 9:
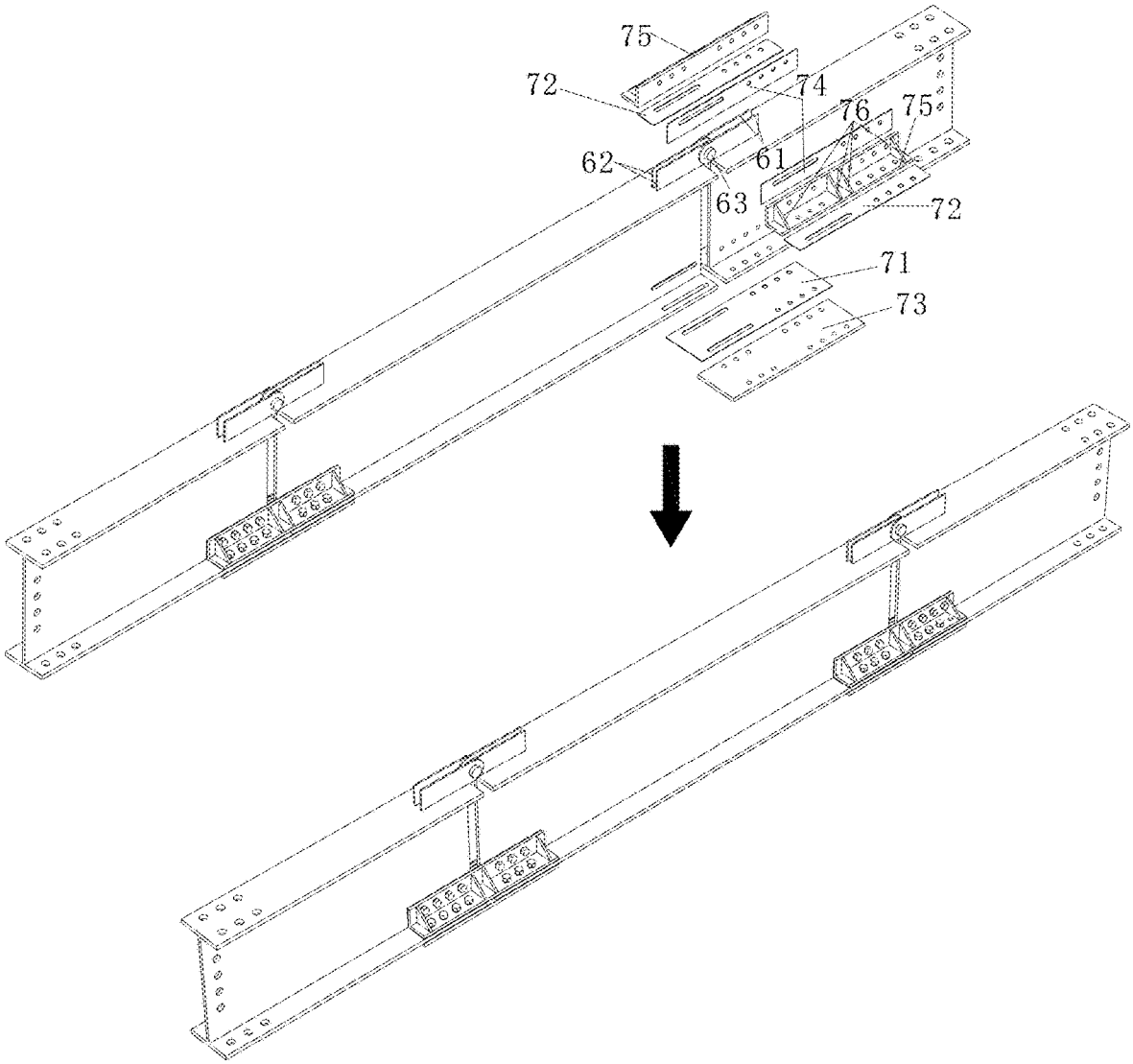
FIG. 9 is a schematic view of the process of connecting the lower cantilever part I-shaped steel column to the middle part I-shaped steel column.
Figure 10:
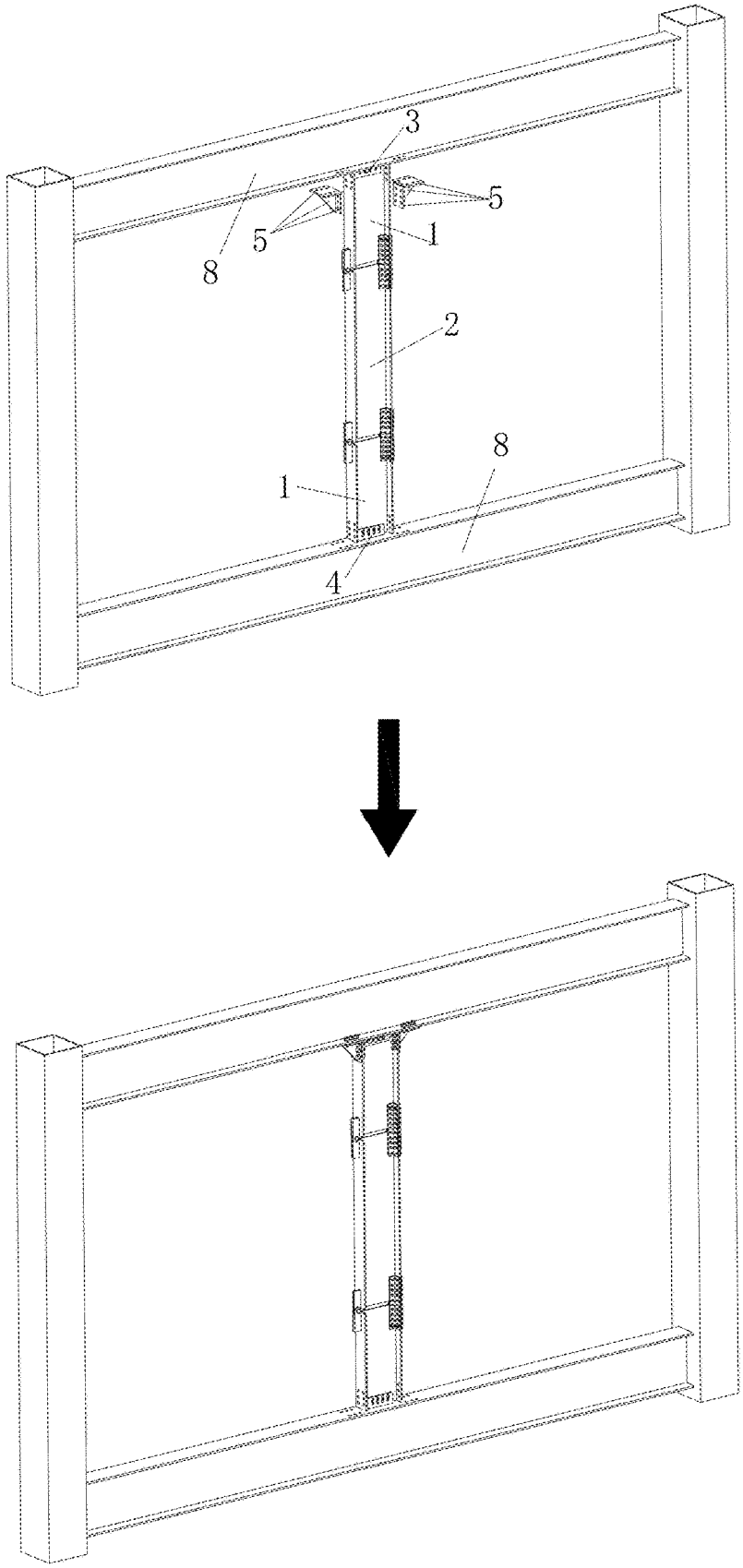
FIG. 10 is a schematic view of the process of connecting the upper end of the friction energy dissipation column to the frame beam.
Figure 11:
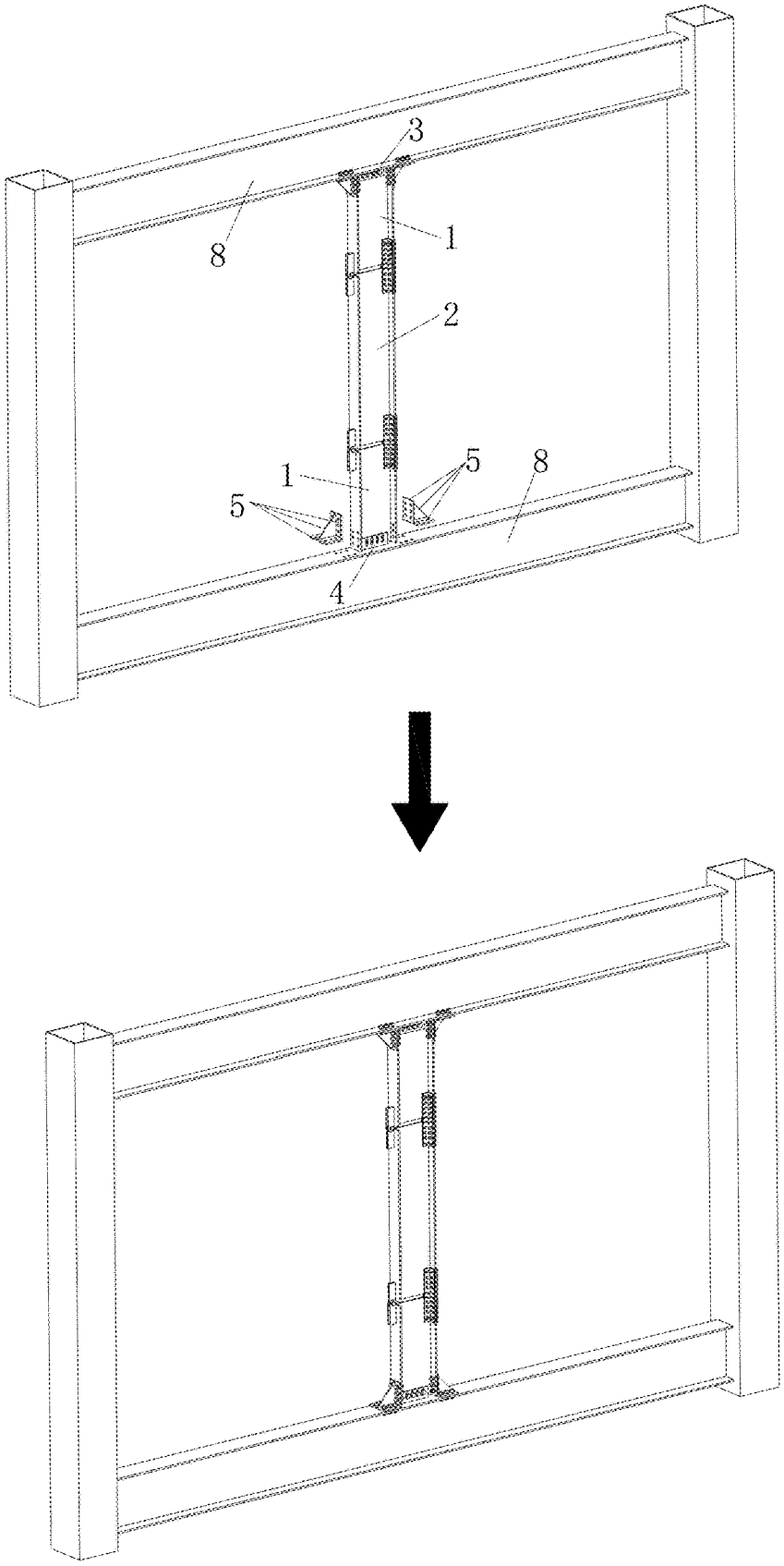
FIG. 11 is a schematic view of the process of connecting the lower end of the friction energy dissipation column to the frame beam.
Figure 12:
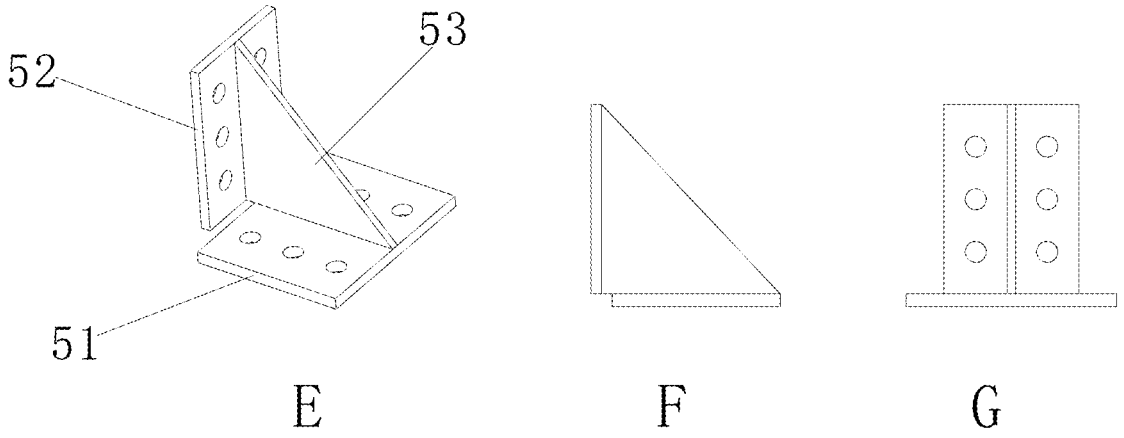
FIG. 12 is a schematic view of the structure of the haunched support according to an embodiment of the present invention, F is a front view and G is a side view.
Figure 13:
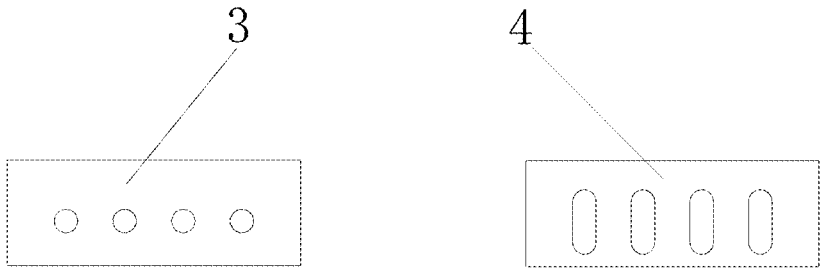
FIG. 13 is a schematic view of the holes of the upper and lower connecting plates.
Figure 14:
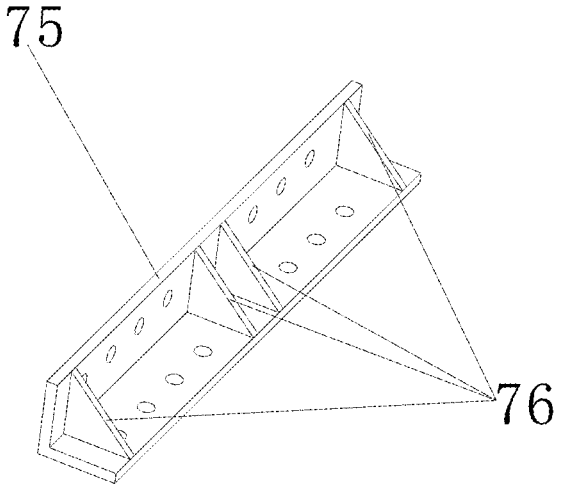
FIG. 14 is a schematic view of the structure of the friction angle steel.
Figure 15:
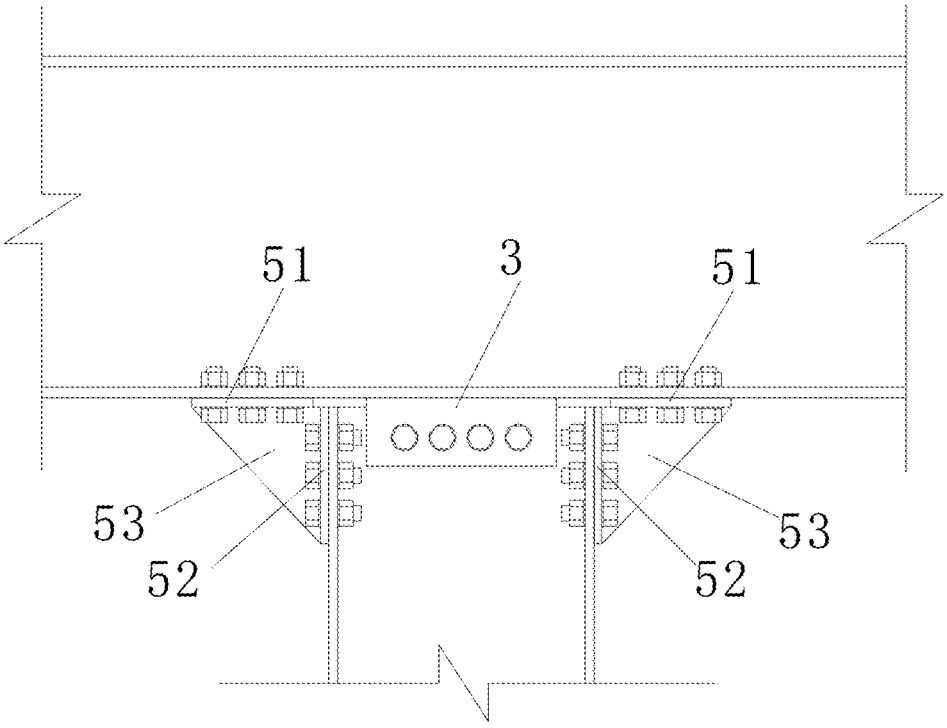
FIG. 15 is a schematic view of a connecting joint at the upper end of the friction energy dissipation column.
Figure 16:
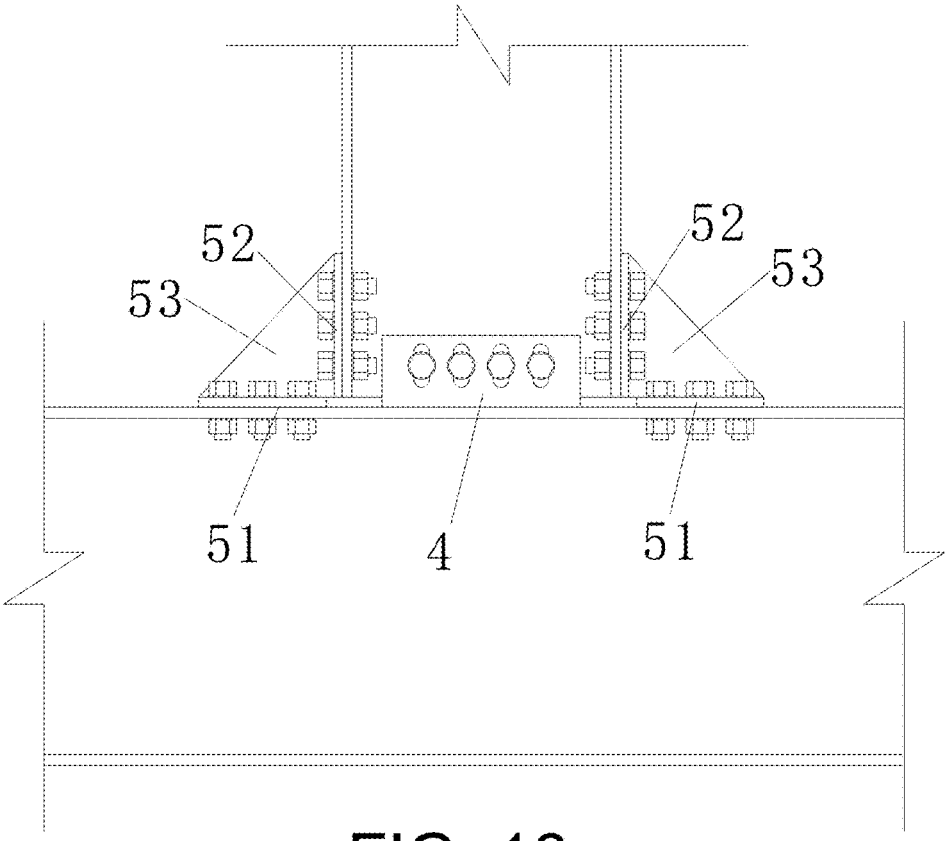
FIG. 16 is a schematic view of a connecting joint at the lower end of the friction energy dissipation column.

In some embodiments of the present invention, as described in conjunction with FIG. 5B, FIG. 6 and FIG. 7, a first friction plate 71 is provided between the friction steel plate 73 and the right side flange of the cantilever part I-shaped steel column 1 and between the friction steel plate 73 and the right side flange of the middle part I-shaped steel column 2, and a second friction plate 72 is provided between the friction angle steel 75 and the right side flange of the cantilever part I-shaped steel column 1 and between the friction angle steel 75 and the right side flange of the middle part I-shaped steel column 2; the materials of the first friction plate 71 and the second friction plate 72 can be made of materials with strong wear resistance and stable friction performance, such as brass and so on; at the same time, the upper friction energy dissipation assembly 7 and the lower friction energy dissipation assembly 7 of the friction energy dissipation column apply a bolt pre-tention force, the bolt pre-tention force applied by the lower friction energy dissipation assembly 7 is lower than the bolt pre-tention force applied by the upper friction energy dissipation assembly 7; with such arrangement, it can be achieved that the friction energy dissipation assembly 7 at the lower side of the friction energy dissipation column undergoes relative sliding to participate in friction energy dissipation under the action of a minor earthquake, and the friction energy dissipation assembly 7 at the upper side does not undergo relative sliding or participate in energy dissipation, while both of them participate in energy dissipation under the action of a strong earthquake.

In some embodiments of the present invention, the first friction plate 71 and the second friction plate 72 on one side of the cantilever part I-shaped steel column 1 are provided with circular holes, and the first friction plate 71 and the second friction plate 72 on one side of the middle part I-shaped steel column 2 are provided with slotted holes.

A low friction material 74 is provided between the friction angle steel 75 and the web of the cantilever part I-shaped steel column 1 and between the friction angle steel 75 and the web of the middle part I-shaped steel column 2, so that the web side does not participate in the sliding friction energy consumption, and only the flange side participates in the friction energy consumption. In some of the embodiments of the present invention, the low-friction material may be butyl rubber.

In some of the embodiments of the present invention, as described in connection with FIG. 5B, FIG. 6, FIG. 7, and FIG. 14, four triangular stiffeners 76 are provided on each friction angle steel 75, wherein one side of two of the triangular stiffeners 76 flush with the end face of the cantilever part I-shaped steel column 1 and the end face of the middle part I-shaped steel column 2, respectively, and the other two triangular stiffeners 76 are symmetrically arranged on both sides of the friction angle steel 75. With such arrangement, it is ensured that the out-of-plane relative dislocation does not occur between the column parts when the friction energy dissipation column is subjected to the out-of-plane force, and the out-of-plane direction is approximately a straight line so that the out-of-plane force mechanism can be effectively exerted.

In some embodiments of the present invention, as described in conjunction with FIG. 5B, FIG. 6 and FIG. 7, the pin shaft connector 6 comprises two main ear plates 61, two auxiliary ear plates 62 and a pin shaft 63, wherein the main ear plates 61 are symmetrically welded on the left side flange of the cantilever part I-shaped steel column 1, the auxiliary ear plates 62 are symmetrically welded on the left side flange of the middle part I-shaped steel column 2, and the two main ear plates 61 are respectively located outside the two auxiliary ear plates 62, the main ear plates 61 are connected to the auxiliary ear plates 62 via the pin shaft 63, and an adaptive installation gap each of the main ear plates 61 and each of the auxiliary ear plates 62. The provision of the double ear plates limits relative out-of-plane misalignment between the column parts.

As described with reference to FIG. 8-FIG. 14, the present invention provides a friction energy dissipation column for bi-directional deformation cooperative and multi-stage working, and the processing method thereof is achieved as follows:

Step 1. aligning the hole positions of the two main ear plates 61 of the upper cantilever part I-shaped steel column 1 and the two auxiliary ear plates 62 of the middle part I-shaped steel column 2, wherein the two main ear plates 61 are on the outer side and the two auxiliary ear plates 62 are on the inner side, and then connecting the two pairs of main ear plates 61 and auxiliary ear plates 62 via a pin shaft 63;

Step 2. connecting the right side of the upper cantilever part I-shaped steel column 1 to the right side of the middle part I-shaped steel column 2 via the friction energy dissipation assembly 7, specifically comprising placing a second friction plate 72 according to the positions of the bolt holes and the slotted holes of the cantilever part I-shaped steel column 1 and the middle part I-shaped steel column 2, and arranging a low friction material 74 at the webs of the two column parts, then placing two friction angle steel 75, and finally placing the second friction plate 72 and the friction steel plate 73, wherein each hole is inserted with a high-strength bolt for fixed connection;

Step 3. connecting the cantilever part I-shaped steel column 1 located below with the middle part I-shaped steel column 2 according to the same process;

Step 4. transporting the connected friction energy dissipation column to a construction site, fixedly connecting the web of the upper cantilever part I-shaped steel column 1 to the upper connecting plate 3 via high-strength bolts according to the principle of hole site correspondence, and then fixedly connecting the first end plate 51 of the two haunched supports 5 to the flange of the frame beam and the second end plate 52 to the flange of the cantilever part I-shaped steel column 1 via high-strength bolts;

Step 5. adjusting the position of the lower cantilever part I-shaped steel column 1 to correspond to the position of slotted hole of the lower connecting plate 4, and fixedly connecting the two via high-strength bolts; Furthermore, according to the principle of hole site correspondence, the first end plate 51 of the two haunched supports 5 is fixedly connected to the flange of the frame beam, the second end plate 52 is fixedly connected to the flange of the lower cantilever part I-shaped steel column 1 via high-strength bolts.

Wherein, before step 1, circular holes are provided on the upper connecting plate 3, the cantilever part I-shaped steel column 1, the friction angle steel 75, and the friction steel plate 73 at corresponding positions, slotted holes are provided on the lower connecting plate 4, slotted holes are provided on the middle part I-shaped steel column 2, and two main ear plates 61 are welded on the flange of the cantilever part I-shaped steel column 1, and two auxiliary ear plates 62 are welded on the flange of the middle part I-shaped steel column 2.

It should be understood that the above-described embodiments of the invention are merely illustrative of the invention for purposes of clarity and are not intended to limit the embodiments of the invention. It will be apparent to those skilled in the art that various other modifications and variations can be made in the present invention without departing from the scope or spirit of the invention. All embodiments need not be, and cannot be, exhaustive. Any modification, equivalent replacement, improvement, etc. made within the spirit and principle of the present invention should be included in the protection scope of the claims of the present invention.

What is claimed is:

1. A friction energy dissipation column for bi-directional deformation cooperative and multi-stage working, the friction energy dissipation column comprising:

cantilever part I-shaped steel columns, a middle part I-shaped steel column, a friction energy dissipation assembly, and a pin shaft connector;

wherein the middle part I-shaped steel column is located between two said cantilever part I-shaped steel columns, and the two cantilever part I-shaped steel columns are aligned with a central axis of the middle part I-shaped steel column;

each of the cantilever part I-shaped steel columns is detachably connected to the middle part I-shaped steel column via the friction energy dissipation assembly and the pin shaft connector;

the friction energy dissipation assemblies are respectively symmetrically arranged on both sides of webs of the cantilever part I-shaped steel column and of webs of the middle part I-shaped steel column, left and right side flanges of the two cantilever part I-shaped steel columns are provided with haunched supports respectively, each haunched support comprises a triangular haunched plate, a first end plate, and a second end plate, wherein the first end plate is fixedly connected to a flange of a frame beam, and the second end plate is fixedly connected to a respective said side flange of the cantilever part I-shaped steel column; the triangular haunched plate and the web of the cantilever part I-shaped steel column are located in a same plane; and the first end plate and the second end plate are provided with a gap at a right angle of the triangular haunched plate so as not to contact each other.

2. The friction energy dissipation column for bi-directional deformation cooperative and multi-stage working according to claim 1, wherein the pin shaft connector comprises two main ear plates, two auxiliary ear plates, and one pin shaft, wherein the main ear plates are symmetrically welded on the left side flange of the cantilever part I-shaped steel column, and the auxiliary ear plates are symmetrically welded on the left side flange of the middle part I-shaped steel column, the main ear plates are connected to the auxiliary ear plates via the pin shaft, the two main ear plates are respectively located outside the two auxiliary ear plates, and a gap is provided between each main ear plate and each auxiliary ear plate.

3. The friction energy dissipation column for bi-directional deformation cooperative and multi-stage working according to claim 1, wherein a web of an upper cantilever part I-shaped steel column is connected to the frame beam via an upper connecting plate, the upper cantilever part I-shaped steel column and the upper connecting plate are both provided with circular holes in one-to-one correspondence, the upper cantilever part I-shaped steel column is fixedly connected to the upper connecting plate via a bolt, and the web of the upper cantilever part I-shaped steel column and a web of the frame beam are located in a same plane;

a web of a lower cantilever part I-shaped steel column is connected to a frame bottom beam via a lower connecting plate, the lower cantilever part I-shaped steel column is provided with circular holes, the lower connecting plate is provided with a vertical slotted hole, the lower cantilever part I-shaped steel column is fixedly connected to the lower connecting plate via a bolt, and the web of the lower cantilever part I-shaped steel column and a web of the frame bottom beam are located in a same plane.

4. The friction energy dissipation column for bi-directional deformation cooperative and multi-stage working according to claim 3, wherein the pin shaft connector comprises two main ear plates, two auxiliary ear plates, and one pin shaft, wherein the main ear plates are symmetrically welded on the left side flange of the cantilever part I-shaped steel column, and the auxiliary ear plates are symmetrically welded on the left side flange of the middle part I-shaped steel column, the main ear plates are connected to the auxiliary ear plates via the pin shaft, the two main ear plates are respectively located outside the two auxiliary ear plates, and a gap is provided between each main ear plate and each auxiliary ear plate.

5. The friction energy dissipation column for bi-directional deformation cooperative and multi-stage working according to claim 1, wherein a plurality of circular bolt holes are provided at the right side flange and the web of the cantilever part I-shaped steel column, and the bolt holes at the right side flange are symmetrically arranged at both sides of the web; the right side flange and the web of the middle part I-shaped steel column are respectively provided with slotted holes, and the slotted holes at the right side flange are symmetrically arranged at both sides of the web, and the circular bolt holes and the slotted holes are used for installing the friction energy dissipation assemblies.

6. The friction energy dissipation column for bi-directional deformation cooperative and multi-stage working according to claim 5, wherein the pin shaft connector comprises two main ear plates, two auxiliary ear plates, and one pin shaft, wherein the main ear plates are symmetrically welded on the left side flange of the cantilever part I-shaped steel column, and the auxiliary ear plates are symmetrically welded on the left side flange of the middle part I-shaped steel column, the main ear plates are connected to the auxiliary ear plates via the pin shaft, the two main ear plates are respectively located outside the two auxiliary ear plates, and a gap is provided between each main ear plate and each auxiliary ear plate.

7. The friction energy dissipation column for bi-directional deformation cooperative and multi-stage working according to claim 1, wherein the friction energy dissipation assembly comprises a friction steel plate, a friction angle steel, and a triangular stiffener, wherein the friction steel plate is detachably connected to right sides of the right side flange of the cantilever part I-shaped steel column and of the right side flange of the middle part I-shaped steel column, the friction angle steel is detachably connected to the right side flange of the I-shaped steel column and the right side flange of the middle part I-shaped steel column, the friction angle steel is also detachably connected to the web of the I-shaped steel column and the web of the middle part I-shaped steel column, and the two friction angle steel are symmetrically arranged on both sides of the webs of the cantilever part I-shaped steel column and of the webs of the middle part I-shaped steel column.

8. The friction energy dissipation column for bi-directional deformation cooperative and multi-stage working according to claim 7, wherein the pin shaft connector comprises two main ear plates, two auxiliary ear plates, and one pin shaft, wherein the main ear plates are symmetrically welded on the left side flange of the cantilever part I-shaped steel column, and the auxiliary ear plates are symmetrically welded on the left side flange of the middle part I-shaped steel column, the main ear plates are connected to the auxiliary ear plates via the pin shaft, the two main ear plates are respectively located outside the two auxiliary ear plates, and a gap is provided between each main ear plate and each auxiliary ear plate.

9. The friction energy dissipation column for bi-directional deformation cooperative and multi-stage working according to claim 7, wherein a first friction plate is provided between the friction steel plate and the right side flange of the cantilever part I-shaped steel column and between the friction steel plate and the right side flange of the middle part I-shaped steel column, and a second friction plate is provided between the friction angle steel and the right side flange of the cantilever part I-shaped steel column and between the friction angle steel and the right side flange of the middle part I-shaped steel column; a low friction material is provided between the friction angle steel and the web of the cantilever part I-shaped steel column and between the friction angle steel and the web of middle part I-shaped steel column;

an upper friction energy dissipation assembly and a lower friction energy dissipation assembly of the friction energy dissipation column apply a bolt pre-tention force, the bolt pre-tention force applied by the lower friction energy dissipation assembly is lower than the bolt pre-tention force applied by the upper friction energy dissipation assembly.

10. The friction energy dissipation column for bi-directional deformation cooperative and multi-stage working according to claim 9, wherein the pin shaft connector comprises two main ear plates, two auxiliary ear plates, and one pin shaft, wherein the main ear plates are symmetrically welded on the left side flange of the cantilever part I-shaped steel column, and the auxiliary ear plates are symmetrically welded on the left side flange of the middle part I-shaped steel column, the main ear plates are connected to the auxiliary ear plates via the pin shaft, the two main ear plates are respectively located outside the two auxiliary ear plates, and a gap is provided between each main ear plate and each auxiliary ear plate.

11. The friction energy dissipation column for bi-directional deformation cooperative and multi-stage working according to claim 7, wherein the friction angle steel is provided with four triangular stiffeners, wherein one side of two of the triangular stiffeners is respectively flush with an end face of the cantilever part I-shaped steel column and an end face of the middle part I-shaped steel column, and another two of the triangular stiffeners are symmetrically arranged at both sides of the friction angle steel.

12. The friction energy dissipation column for bi-directional deformation cooperative and multi-stage working according to claim 11, wherein the pin shaft connector comprises two main ear plates, two auxiliary ear plates, and one pin shaft, wherein the main ear plates are symmetrically welded on the left side flange of the cantilever part I-shaped steel column, and the auxiliary ear plates are symmetrically welded on the left side flange of the middle part I-shaped steel column, the main ear plates are connected to the auxiliary ear plates via the pin shaft, the two main ear plates are respectively located outside the two auxiliary ear plates, and a gap is provided between each main ear plate and each auxiliary ear plate.

13. A method for machining the friction energy dissipation column for bi-directional deformation cooperative and multi-stage working according to claim 1, wherein the method comprises following steps of:

step 1. connecting one end of the cantilever part I-shaped steel column located above to one end of the middle part I-shaped steel column using the pin shaft connector;

step 2. connecting another end of the upper cantilever part I-shaped steel column to another end of the middle part I-shaped steel column via the friction energy dissipation assembly;

step 3. connecting the cantilever part I-shaped steel column located below with the middle part I-shaped steel column according to a same process;

step 4. transporting the connected friction energy dissipation column to a construction site, fixing an upper connecting plate at the end of the cantilever part I-shaped steel column located above, and fixing a lower connecting plate at the end of the cantilever part I-shaped steel column located below;

when the haunched supports are provided, the haunched supports are respectively fixedly installed at left and right side flanges of the two cantilever part I-shaped steel columns.

* * * * *